US010474104B2

(12) United States Patent
Helfer et al.

(10) Patent No.: US 10,474,104 B2
(45) Date of Patent: Nov. 12, 2019

(54) RESONATOR WITH FINE ADJUSTMENT VIA AN INDEX-ASSEMBLY

(71) Applicant: ETA SA MANUFACTURE HORLOGERE SUISSE, Grenchen (CH)

(72) Inventors: Jean-Luc Helfer, Le Landeron (CH); Marc Stranczl, Nyon (CH); Laurent Jeanneret, Villers le Lac (FR); Xavier Berdat, Delemont (CH)

(73) Assignee: ETA SA MANUFACTURE HORLOGERE SUISSE, Grenchen (CH)

( * ) Notice: Subject to any disclaimer, the term of this patent is extended or adjusted under 35 U.S.C. 154(b) by 122 days.

(21) Appl. No.: 15/570,793

(22) PCT Filed: May 13, 2016

(86) PCT No.: PCT/EP2016/060814
§ 371 (c)(1),
(2) Date: Oct. 31, 2017

(87) PCT Pub. No.: WO2016/192957
PCT Pub. Date: Dec. 8, 2016

(65) Prior Publication Data

US 2018/0120769 A1 May 3, 2018

(30) Foreign Application Priority Data

Jun. 3, 2015 (EP) ..... 15170557

(51) Int. Cl.
*G04B 17/26* (2006.01)
*G04B 17/32* (2006.01)
(Continued)

(52) U.S. Cl.
CPC ..... *G04B 17/325* (2013.01); *G04B 17/066* (2013.01); *G04B 17/26* (2013.01); *G04B 18/02* (2013.01)

(58) Field of Classification Search
CPC ..... G04B 17/32; G04B 17/066; G04B 17/26; G04B 18/02; G04B 17/325
See application file for complete search history.

(56) References Cited

U.S. PATENT DOCUMENTS 209,642 A 11/1878 Berlitz et al.
8,348,497 B2 * 1/2013 Daout ..... G04B 17/20 368/175
(Continued)

FOREIGN PATENT DOCUMENTS

CH 327 796 2/1958
EP 1 431 844 A1 6/2004
(Continued)

OTHER PUBLICATIONS

International Search Report dated Sep. 23, 2016 in PCT/EP2016/060814 Filed May 13, 2016.

*Primary Examiner* — Sean P Kayes
(74) *Attorney, Agent, or Firm* — Oblon, McClelland, Maier & Neustadt, L.L.P.

(57) ABSTRACT

A resonator of the inertia/elasticity type includes a balance-spring coupled to an inertia flywheel and a system for adjusting the frequency of the resonator including an index-assembly arranged to cooperate with one coil of the balance-spring in order to selectively choose the active length of the balance-spring. The portion of the coil of the balance-spring cooperating with the index-assembly includes at least one area of larger cross-section than the other balance-spring coils for finer adjustment of the frequency of the resonator.

11 Claims, 2 Drawing Sheets

(51) Int. Cl.
*G04B 17/06* (2006.01)
*G04B 18/02* (2006.01)

(56) References Cited

U.S. PATENT DOCUMENTS

| | | | | |
|---|---|---|---|---|
| 8,764,282 | B2 * | 7/2014 | Von Gunten | F16F 1/10 368/169 |
| 9,134,701 | B2 * | 9/2015 | Bucaille | G04B 17/06 |
| 9,658,598 | B2 * | 5/2017 | Ching | G04B 17/066 |
| 10,018,964 | B2 * | 7/2018 | Helfer | G04B 17/063 |
| 2006/0055097 | A1 | 3/2006 | Conus et al. | |
| 2006/0262652 | A1 | 11/2006 | Musy et al. | |
| 2011/0069591 | A1 | 3/2011 | Daout | |
| 2015/0277382 | A1 | 10/2015 | Conus et al. | |

FOREIGN PATENT DOCUMENTS

| | | | |
|---|---|---|---|
| EP | 1 445 670 | A1 | 8/2004 |
| EP | 1 473 604 | A1 | 11/2004 |
| EP | 1 473 608 | A2 | 11/2004 |
| EP | 2 233 989 | A1 | 9/2010 |
| EP | 2 299 336 | A2 | 3/2011 |

* cited by examiner

RESONATOR WITH FINE ADJUSTMENT VIA AN INDEX-ASSEMBLY

CROSS-REFERENCE TO RELATED APPLICATIONS

The present application is a national stage application in the United States of International Patent Application PCT/EP2016/060814, filed on May 13, 2016, which claims priority to European Patent Application 15170557.1, filed on June 3, 2015. The entire disclosures of the above patent applications are hereby incorporated herein by reference.

FIELD OF THE INVENTION

The invention relates to a resonator with fine adjustment via an index-assembly and more particularly to a resonator whose frequency can be adjusted with a smaller variation for the same shift of the index-assembly.

BACKGROUND OF THE INVENTION

Adjustment of the frequency of a balance/balance-spring resonator can be achieved through modification of the inertia of the balance or of the elastic torque of the balance-spring.

It is known to use an index-assembly to modify the elastic torque of the balance-spring. An index-assembly generally includes two stop members intended to form the count-point, i.e. to define the length of the balance-spring strip, called the active length, which will work in contraction and expansion to provide the elastic torque of the resonator.

However, adjustment via an index-assembly is very sensitive, i.e. a slight shift of the stop members results in a large variation in frequency, and entails the development of micrometric screw systems designed to make adjustment more precise.

SUMMARY OF THE INVENTION

It is an object of the present invention to overcome all or part of the aforementioned drawbacks by proposing a resonator with a frequency adjustment system making finer frequency adjustment possible by means of an index-assembly facilitating the final timing work during manufacture and after-sales setting.

To this end, the invention relates to a resonator of the inertia/elasticity type comprising a balance-spring coupled to an inertia flywheel and a system for adjusting the frequency of the resonator comprising an index-assembly including two stop members arranged to cooperate with one coil of the balance-spring in order to selectively choose the active length of the balance-spring, characterized in that the portion of the balance-spring coil cooperating with the index-assembly includes at least one area of greater cross-section than the other coils of the balance-spring so that the index-assembly has less impact on the resonator frequency than on the non-thickened cross-section of the rest of the balance-spring.

Advantageously according to the invention, it is thus understood that an extra thickness of material on the balance-spring coil that cooperates with the index-assembly is sufficient to achieve finer adjustment of the rate of the resonator. Indeed, it was found that an area of larger cross-section results in stiffening, capable, in combination with an index-assembly, of diminishing the effect of this area on the elastic torque of the balance-spring compared to the effect on the rest of the non-thickened balance-spring. It is thus clear that the shift of the index-assembly along the thickened section will have less impact on the resonator frequency than on the non-thickened section of the rest of the balance-spring, which advantageously makes it possible to obtain the same variation in rate with a greater shift of the index-assembly.

In accordance with other advantageous variants of the invention:

- the portion of the balance-spring coil cooperating with the index-assembly includes at least two areas of different and larger cross-section than the other balance-spring coils for finer adjustment of the resonator frequency, in at least two distinct ratios;
- said at least one area has a cross-section comprised between 1.5 and 5 times greater than the other balance-spring coils;
- the two stop members are selectively positioned on either side of the thickness of the balance-spring and movable in the same direction as the portion of the balance-spring coil cooperating with the index-assembly;
- according to an alternative, the two stop members are movable in rotation relative to an axis;
- the axis of rotation of the stop members is centred on the centre of the circle inscribed in the opening of a balance-spring collet;
- according to another alternative, the two stop members are movable in translation relative to a straight line;
- the line of translation of the stop members passes through the centre of the circle inscribed in the opening of a balance-spring collet;
- the two stop members are formed by a balance-spring boot or by two index pins;
- the index-assembly and the portion of the balance-spring coil cooperating with the index-assembly are arranged to offer the resonator an adjustment of one second per day for a shift of the index-assembly comprised between 10 and 50 micrometers along the portion of the balance-spring coil cooperating with the index-assembly.

Moreover, the invention relates to a timepiece comprising a cock and a plate, characterized in that the timepiece further includes a resonator according to any of the preceding variants, the index-assembly being mounted on the cock and the resonator being mounted to pivot, by means of a staff, between the cock and the plate.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Adjustment via an index-assembly is very sensitive, i.e. a slight shift of the stop members results in a large variation in frequency, and entails the development of micrometric screw systems designed to make adjustment more precise. By way of information, a variation of one second per day is generally obtained with a shift of approximately 2 to 3 micrometers of the index-assembly stop members along the outer coil, which corresponds to an index rotation of around 0.05°.

The present invention proposes to restore interest in adjustment via an index-assembly by proposing an adjustment to the resonator of one second per day for a larger shift of the index-assembly such as, for example, comprised between 10 and 50 micrometers, along the portion of the balance-spring coil cooperating with the index-assembly.

Advantageously according to the invention, it is even clear that it is possible to envisage a universal adjustment for the calibres of the same industrial group or the same watch brand, consisting in developing an identical shift of the index for each calibre, allowing the one second-per-day variation of the resonator. Indeed, such a universal adjustment would simplify the final timing work during manufacture and after-sales setting.

Figure 1:
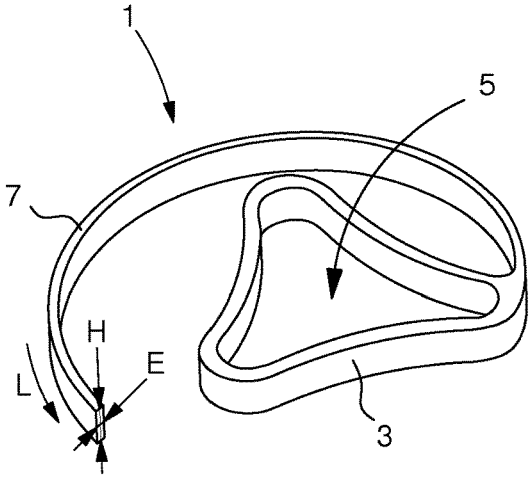
FIG. 1 is a representation of one part of an example balance-spring according to the invention.

Thus, the invention relates to a resonator of the inertia/elasticity type comprising a balance-spring coupled to an inertia flywheel such as, for example, a balance/balance-spring resonator. A balance-spring 1, as partially shown in FIG. 1, includes a collet 3 forming an opening 5 intended to receive a balance staff. Collet 3 is integral with a strip 7 wound on itself into several coils. In the example of FIG. 1, it can be seen that strip 7 has a thickness E, a height H and a length L.

Further, the resonator includes a frequency adjustment system comprising an index-assembly arranged to cooperate with one coil of the balance-spring to selectively choose the active length of the balance-spring. The coil is preferably the outer coil of the balance-spring for evident reasons of accessibility. However, it is also possible to use, as an equivalent alternative, the penultimate coil, i.e. the coil preceding the outer coil.

Advantageously according to the invention, the portion of the balance-spring coil cooperating with the index-assembly comprises at least one area of larger cross-section than the other balance-spring coils for finer adjustment of the resonator frequency. Consequently, as explained above, each area of larger cross-section than the other balance-spring coils may have a variation in thickness E and/or a variation in height H to modify its cross-section.

Indeed, it was found that an area of larger cross-section results in stiffening, capable, in combination with an index-assembly, of diminishing the effect of this area on the elastic torque of the balance-spring compared to the effect on the rest of the non-thickened balance-spring. It is thus clear that the shift of the index-assembly along the thickened section will have less impact on the resonator frequency than on the non-thickened section of the rest of the balance-spring, which advantageously makes it possible to obtain the same variation in rate with a greater shift of the index-assembly.

Figure 2:
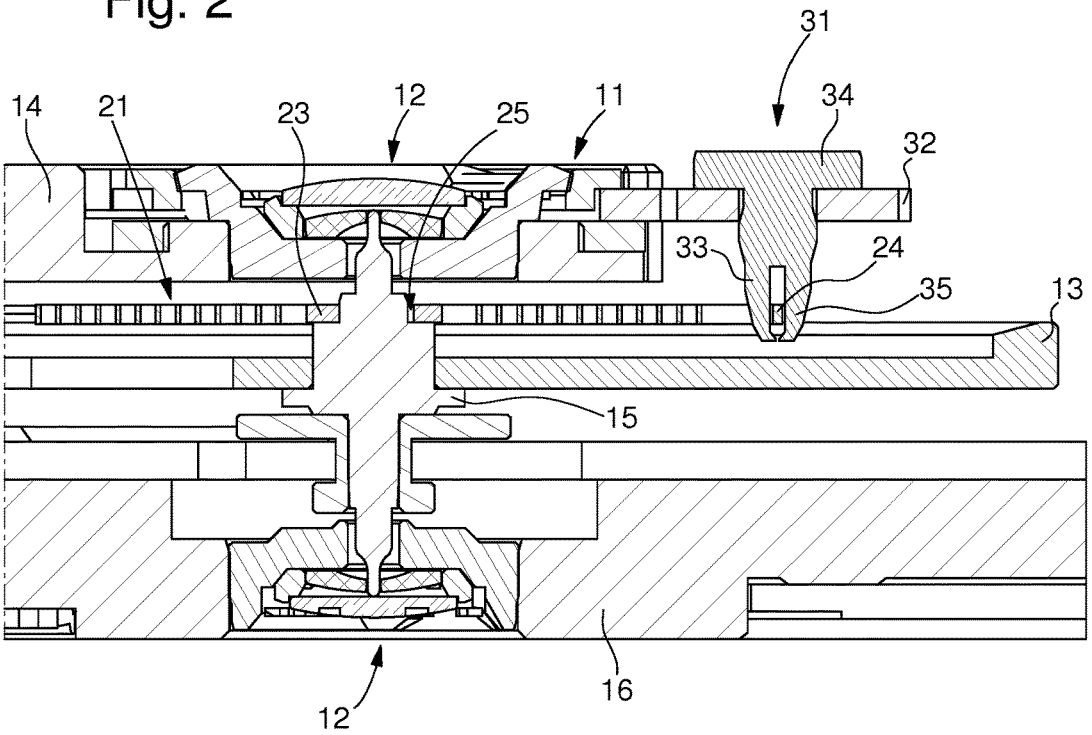
FIG. 2 is a representation of one part of an example index-assembly according to the invention.
Figure 3:
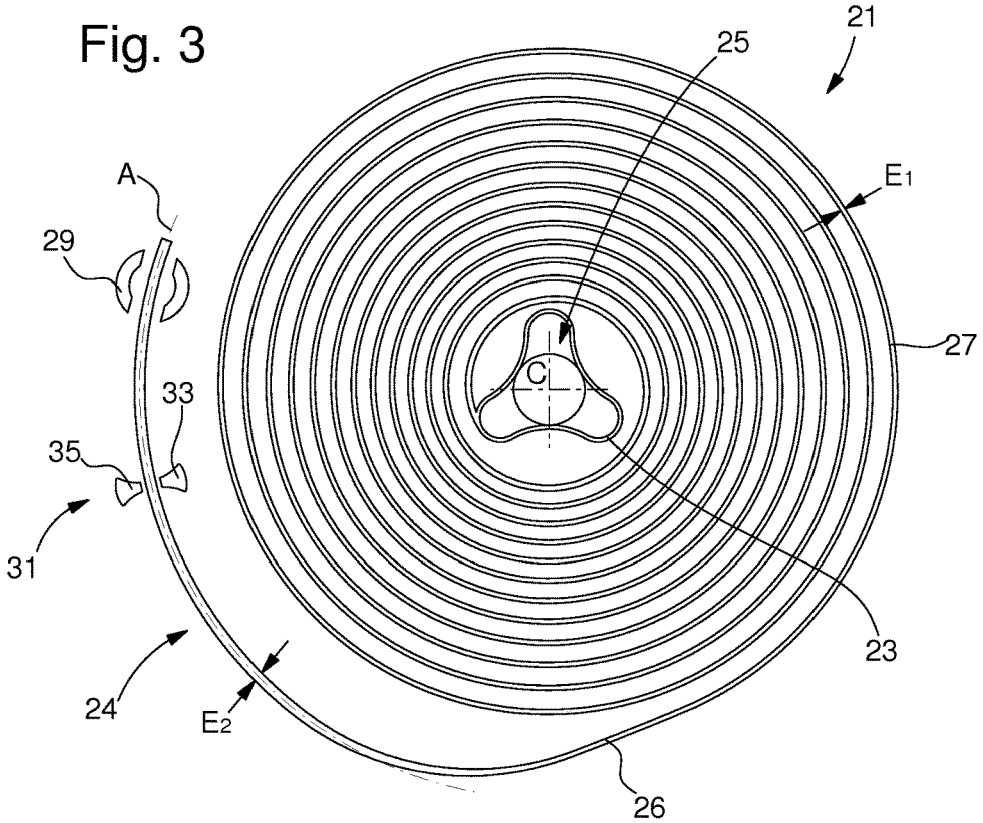
FIG. 3 is a top view of a balance-spring according to a first embodiment of the invention.

A first embodiment of the invention is illustrated in FIGS. 2 and 3. In FIG. 2, there is shown a resonator 11 of the inertia/elasticity type comprising a balance-spring 21 coupled to an inertia wheel 13 on a staff 15. With the aid of staff 15, resonator 11 is thus mounted to pivot between a cock 14 and a plate 16 via, for example, bearings 12. In the usual manner, balance-spring 21 is thus mounted between staff 15 via its collet 23 and cock 14 via the balance-spring stud 29 pinned up to the end of its outer coil 26.

Index-assembly 31 is also mounted on cock 14 and includes two stop members 33, 35. Index-assembly 31 is arranged to cooperate, preferably, with one portion 24 of outer coil 26 of balance-spring 21 which includes at least one area of larger cross-section than the other balance-spring coils for finer adjustment of the frequency of resonator 11. However, it is also possible to use, as an equivalent alternative, a thickened portion on the penultimate coil, i.e. the coil preceding outer coil 26.

In the example of FIG. 2, it is seen that the stop members 33, 35 are formed by a boot 34 mounted on index 32. Alternatively, boot 34 may be replaced by two pins to form stop members 33, 35.

Preferably, the cross-sectional thickening is achieved simply by an increased thickness of area 24 as illustrated in FIGS. 2 and 3. It is thus clear that most of strip 27 of balance-spring 21 has a thickness $E_1$ comprised between 20 and 50 micrometres and an area 24 on its outer coil 26 has a thickness $E_2$ greater than thickness $E_1$. Thus, depending on the spacing of stop members 33, 35 and the desired scale of adjustment by the index-assembly, the extra thickness $E_2$ of area 24 is comprised between 50% and 200% with respect to that $E_1$ of the rest of the balance-spring, i.e. is comprised between 1.5 and 3 times thickness $E_1$. In the example illustrated in FIG. 3, thickness $E_2$ is two times greater than that of the rest of balance-spring 21.

Advantageously according to the invention, this type of balance-spring 21 may be obtained by additive or destructive manufacturing methods. Thus, among non-limiting examples of additive or destructive manufacturing methods the following may be cited: LIGA processes, three-dimensional printing, methods mixing mask photolithography and dry or wet etching according to the patterns of said mask, methods mixing alloy casting and wire rolling in at least two distinct consecutive sections or laser etching.

It is clear in this regard that the balance-spring can be manufactured from numerous materials. By way of non-limiting examples, the balance-spring may thus be manufactured from a base of silicon, ceramic or metal. When the balance is silicon-based, it may include, for example, single crystal silicon, doped single crystal silicon, polycrystalline silicon, doped polycrystalline silicon, porous silicon, silicon oxide, quartz, silica, silicon nitride or silicon carbide.

Further, when the balance-spring is ceramic based, it may include, for example, photostructurable glass, borosilicate, aluminosilicate, quartz glass, zerodur, single crystal corundum, polycrystalline corundum, alumina, aluminium oxide, aluminium nitride, single crystal ruby, polycrystalline ruby, zirconium oxide, titanium oxide, titanium nitride, titanium carbide, tungsten nitride, tungsten carbide, boron nitride or boron carbide.

Finally, when the balance-spring is metal-based, it may include, for example, an iron alloy like 15P, 20AP or 316L steel, or NIVAROX CT, a copper alloy such as brass, a nickel alloy such as nickel silver or NIVAFLEX, titanium or an alloy thereof, gold or an alloy thereof, silver or an alloy thereof, platinum or an alloy thereof, ruthenium or an alloy thereof, rhodium or an alloy thereof, or palladium or an alloy thereof.

Thus, by way of example, thickness $E_2$ and index-assembly 31 are arranged to offer an adjustment of resonator 11 of one second per day for a shift of index-assembly 31 comprised between 10 and 50 micrometers, such as, for example, 20 micrometers, along thickened area 24 of outer coil 26 of balance-spring 21.

It is thus clear that, in addition to the difference in thickness in area 24, the two stop members 33, 35 of index-assembly 31 are selectively positioned on either side of thickness $E_2$ of area 24 of balance-spring 21 and are movable in the same direction A as the length of area 24 of outer coil 26.

In the example of FIG. 3, direction A forms an arc of a circle of centre C of the circle inscribed in opening 25 of collet 23 of balance-spring 21. This configuration is obtained since, in the example of FIGS. 2 and 3, the two stop members 33, 35 are movable in rotation with respect to an axis coincident with that of staff 15. In other words, the circle inscribed in opening 25 of collet 23 of balance-spring 21 visible in FIG. 3 represents the external section of staff 15 at the contact thereof with collet 23.

Figure 4:
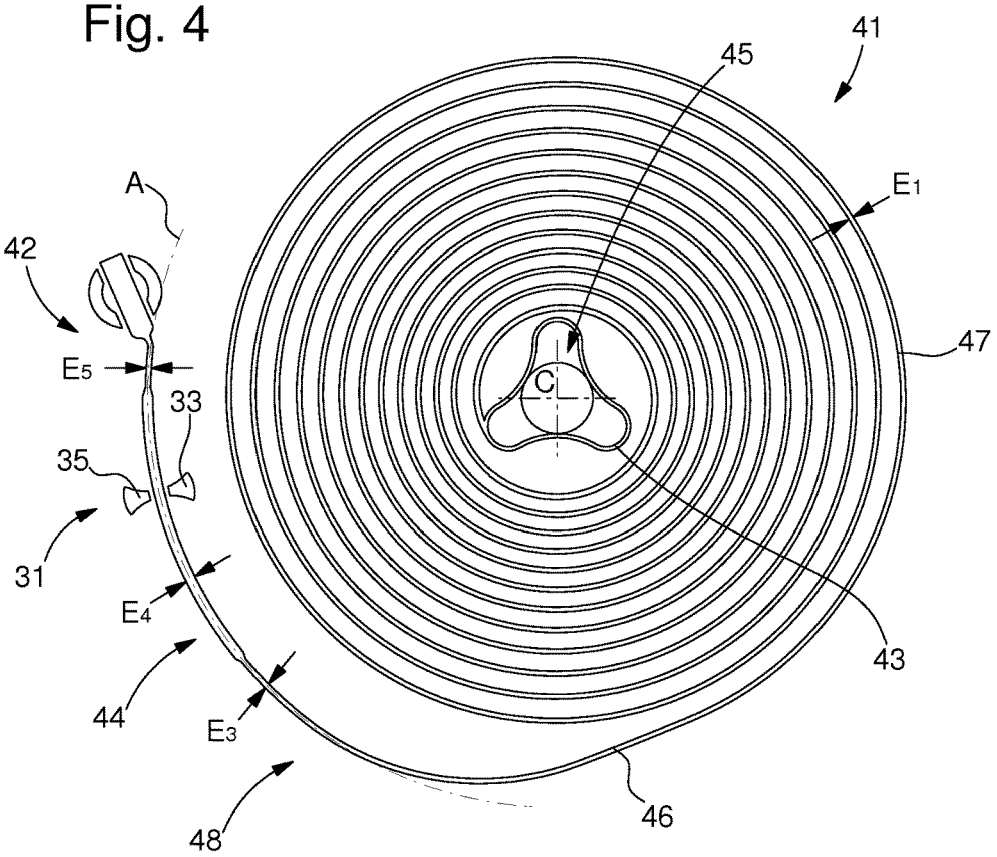
FIG. 4 is a top view of a balance-spring according to a second embodiment of the invention.

According to a second embodiment visible in FIG. 4, the portion of the coil of balance-spring 41 cooperating with index-assembly 31 is also outer coil 46, and includes at least two areas 42, 44, 48 of different and larger cross-section than the other coils of balance-spring 41 for finer adjustment of the resonator frequency, in at least two distinct ratios.

Consequently, in the example of FIG. 4, the three thicknesses $E_3$, $E_4$, $E_5$ and index-assembly 31 are arranged to offer three adjustments of the resonator of one second per day for a shift of index-assembly 31 comprised between 10 and 50 micrometers, such as, for example, respectively 10, 20 and 10 micrometers, respectively along thickened areas $E_5$, $E_4$ and $E_3$ of outer coil 46 of balance-spring 41. In the example illustrated in FIG. 4, thicknesses $E_5$, $E_4$ and $E_3$ are respectively 50%, 100% and 50% greater than that $E_1$ of the rest of balance-spring 41.

Thus, advantageously according to the two embodiments of the invention, a timepiece comprising the resonator according to the invention may be developed with the possibility of choosing a finer or even universal adjustment, which makes the use of index-assembly adjustment more attractive for the final timing work during manufacture and after-sales setting.

Further, according to an alternative (not represented), the variation in thickness between areas $E_5$, $E_4$, $E_3$, $E_2$ and $E_1$ could be progressive between said areas in order to offer a continuously variable adjustment of the resonator for a shift of index-assembly 31 between the areas of thicknesses $E_5$, $E_4$, $E_3$, $E_2$ and $E_1$.

Of course, this invention is not limited to the illustrated example but is capable of various variants and modifications that will appear to those skilled in the art. In particular, the arrangement of areas 24, 42, 44, 48 and of index-assembly 31 may be modified, for example for reasons of ease of implementation.

Figure 5:
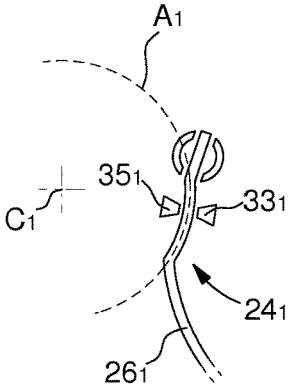
FIGS. 5 to 7 are partial top view representations of alternative resonators according to the invention.

According to a first alternative illustrated in FIG. 5, axis $C_1$ of rotation of the index-assembly may not be coincident with the centre C of the circle inscribed in the opening of the balance-spring collet. As visible in FIG. 5, the arrangement will be adapted so that the two stop members $\mathbf{33}_1$, $\mathbf{35}_1$ of the index-assembly are selectively positioned on either side of the thickness of area $\mathbf{24}_1$ of the balance-spring and are movable in the same direction $A_1$ as the length of area $\mathbf{24}_1$ of outer coil $\mathbf{26}_1$.

Figure 6:
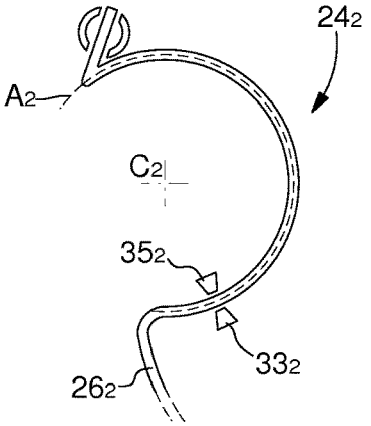

According to a second alternative illustrated in FIG. 6, axis $C_2$ of rotation of the index-assembly may even be substantially at the centre of thickened area $\mathbf{24}_2$ of outer coil $\mathbf{26}_2$. As visible in FIG. 6, the arrangement will be adapted so that the two stop members $\mathbf{33}_2$, $\mathbf{35}_2$ of the index-assembly are selectively positioned on either side of the thickness of area $\mathbf{24}_2$ of the balance-spring and are movable in the same direction $A_2$ as the length of area $\mathbf{24}_2$ of outer coil $\mathbf{26}_2$.

Figure 7:
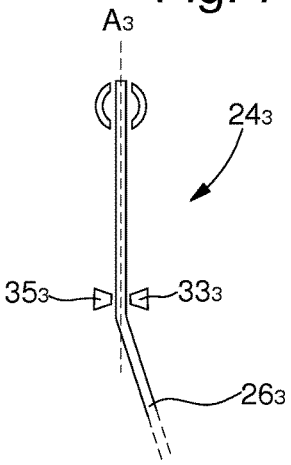

According to a third alternative illustrated in FIG. 7, the two stop member $\mathbf{33}_3$, $\mathbf{35}_3$ of the index-assembly may even be movable in translation with respect to a straight line. As visible in FIG. 7, the arrangement will be adapted so that the two stop members $\mathbf{33}_3$, $\mathbf{35}_3$ of the index-assembly are selectively positioned on either side of the thickness of area $\mathbf{24}_3$ of the balance-spring and are movable in the same direction $A_3$ as the length of area $\mathbf{24}_3$ of outer coil $\mathbf{26}_3$. Further, if the line of translation passes through centre C of the circle inscribed in the opening of the balance-spring collet, the adjustment of rate by the index-assembly does not modify the angle formed between the outlet of the balance-spring at the collet and the count-point. It is thus clear that this would provide a chronometric advantage.

The invention claimed is:

1. A resonator of an inertia/elasticity type comprising:

a balance-spring coupled to an inertia flywheel and a system for adjustment of a frequency of the resonator including an index-assembly comprising two stop members arranged to cooperate with a coil of the balance-spring in order to selectively choose an active length of the balance-spring, wherein a portion of the coil of the balance-spring cooperating with the index-assembly includes at least one area of greater cross-section than other coils of the balance-spring so that a correction of the index-assembly has less impact on the frequency of the resonator than on a non-thickened cross-section of a rest of the balance-spring, and wherein the index-assembly and the portion of the coil of the balance-spring cooperating with the index-assembly are arranged to offer the resonator an adjustment of one second per day for a shift of the index-assembly comprised between 10 and 50 micrometers along the portion of the coil of the balance-spring cooperating with the index-assembly.

2. The resonator according to claim 1, wherein the portion of the coil of the balance-spring cooperating with the index-assembly includes at least two areas of different and larger cross-section than the other balance-spring coils for finer adjustment of the frequency of the resonator, in at least two distinct ratios.

3. The resonator according to claim 1, wherein said at least one area includes a cross-section comprised between 1.5 and 5 times greater than the other coils of the balance spring.

4. The resonator according to claim 1, wherein the two stop members are selectively positioned on either side of the thickness of the balance spring and are movable in the same direction as the portion of the coil of the balance spring cooperating with the index-assembly.

5. The resonator according to claim 1, wherein the two stop members are movable in rotation with respect to an axis.

6. The resonator according to claim 5, wherein the axis of rotation of the stop members is centered on the center of a circle inscribed in an opening of a collet of the balance-spring.

7. The resonator according to claim 1, wherein the two stop members are movable in translation with respect to a straight line.

8. The resonator according to claim 7, wherein the line of translation of the stop members passes through a center of a circle inscribed in an opening of a collet of the balance-spring.

9. The resonator according to claim 1, wherein the two stop members are formed by a balance-spring boot.

10. The resonator according to claim 1, wherein the two stop members are formed by two index pins.

11. A timepiece comprising:

a cock, a plate, and the resonator according to claim 1, wherein the index-assembly is mounted on the cock and the resonator is mounted to pivot, by means of a staff, between the cock and the plate.

* * * * *